US011027963B1

(12) United States Patent
Dupuis

(10) Patent No.: US 11,027,963 B1
(45) Date of Patent: Jun. 8, 2021

(54) METHOD AND APPARATUS FOR DISPENSING FLUIDS FROM CONTAINERS

(71) Applicant: Perry A. Dupuis, Breaux Bridge, LA (US)

(72) Inventor: Perry A. Dupuis, Breaux Bridge, LA (US)

( * ) Notice: Subject to any disclaimer, the term of this patent is extended or adjusted under 35 U.S.C. 154(b) by 0 days.

(21) Appl. No.: 16/576,430

(22) Filed: Sep. 19, 2019

Related U.S. Application Data

(60) Provisional application No. 62/733,731, filed on Sep. 20, 2018.

(51) Int. Cl.
*B67D 3/00* (2006.01)

(52) U.S. Cl.
CPC ..... *B67D 3/0035* (2013.01)

(58) Field of Classification Search
CPC ... B67D 3/0035; B05B 11/30; B05B 11/0054; B05B 11/0056
USPC ..... 222/321.1, 628, 372, 631, 185.1
See application file for complete search history.

(56) References Cited

U.S. PATENT DOCUMENTS 774,986 A * 11/1904 Kammerer ..... F25D 23/12 62/331
1,142,210 A * 6/1915 Wagner ..... B67D 3/0035 222/88
2,655,286 A * 10/1953 Barbaro ..... B67B 7/28 222/82
3,966,095 A * 6/1976 Chappell ..... A47K 5/1205 222/384
5,111,966 A * 5/1992 Fridman ..... B67D 3/00 222/1
5,114,048 A * 5/1992 Minke ..... A47K 5/12 222/135
5,509,583 A * 4/1996 Dolson ..... B67D 3/0035 222/185.1
5,947,339 A * 9/1999 Boshears ..... B67D 1/0425 222/135
8,220,667 B1 * 7/2012 Butcher ..... A45D 34/00 222/196
2013/0037576 A1 * 2/2013 Gevorgian ..... G01F 11/34 222/321.1
2013/0341355 A1 * 12/2013 Weaver ..... B67D 3/0035 222/108
2018/0064064 A1 * 3/2018 Sayag ..... B67D 3/0035

* cited by examiner

*Primary Examiner* — Vishal Pancholi
(74) *Attorney, Agent, or Firm* — Ted M. Anthony

(57) ABSTRACT

A dispensing assembly includes a container support section and a pump support section. The container support section securely supports and holds a jug or other conventional container in an inverted position so that an outlet (which is normally facing upward) is instead facing in a generally downward orientation such that any liquids in the container will gravity feed toward the downwardly-facing outlet. A manual pump assembly is held by the pump support section. A conduit generally extends from the container outlet to an inlet of the pump assembly in order to permit fluid to flow from the container to the pump assembly. A reusable cap member having a check valve assembly and quick-connect coupling can be installed on the threaded outlet of the container. Fluid (including, without limitation, thick or highly viscous fluids) can be efficiently dispensed in controlled amounts.

17 Claims, 4 Drawing Sheets

METHOD AND APPARATUS FOR DISPENSING FLUIDS FROM CONTAINERS

CROSS REFERENCES TO RELATED APPLICATIONS

This application claims priority of U.S. Provisional Patent Application Ser. No. 62/733,731, filed Sep. 20, 2018, incorporated by reference herein.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a method and apparatus for dispensing fluids from a container. More particularly, the present invention pertains to an assembly for receiving a conventional container and selectively dispensing fluids (including, without limitation, highly viscous liquids) in controlled amount(s) from said container, while ensuring removal of substantially all of said fluids from said container.

2. Description of the Related Art

In many different circumstances and applications, fluids are distributed and/or stored in large containers, even though a relatively small volume of such fluids is typically dispensed from said containers at any particular time. By way of illustration, but not limitation, hair care products (such as, for example, liquid shampoo and conditioner) used in salons and other similar establishments are frequently distributed and/or stored in large containers (such as, for example, jugs having a capacity of a gallon or 2 liters). In such cases, a conventional hand pump assembly is frequently installed on the outlet spout of a conventional container; a siphon tube extends from said pump into the inner chamber of the container and is used to draw fluid from the bottom portion of the container. Fluid from within the container is not poured from the outlet spout. Rather, fluid is pumped out of the outlet of the container using said pump assembly, typically in volumes of a few ounces or less, with each pump or actuation of the pump assembly.

Conventional containers and pump assemblies frequently suffer from a number of significant limitations. For example, such pump assemblies typically do not extract all fluids from the bottom or lower portions of an upright container, particularly when fluid(s) in said containers are thick and/or have a relatively high viscosity (like, for example, liquid shampoo, hair conditioner or liquid soap). In such cases, a portion of the fluid in collects or pools near the bottom of the container but remains inaccessible to the inlet of the siphon tube. As a result, some volume of residual fluid typically remains in the bottom of a container and cannot be pumped from said container.

Generally, such residual or un-extracted fluid volume remaining within a container goes unused when an "empty" container is discarded. Over time, such small amounts of un-extracted residual fluids can add up to a significant aggregate volume of liquid that is essentially wasted or left unused. Such waste can be particularly significant in applications where numerous containers are routinely used, such as hair studios, beauty salons and the like.

In order to prevent such waste, users will frequently overturn the containers—that is, invert the containers so that the outlet, which is typically at the top of the container, is pointed in a substantially downward orientation. Such containers are inverted in order to allow any residual fluids to gravity feed and, over time, collect in the (inverted or downwardly facing) outlet spout of the container. In this manner, users attempt to access residual fluids remaining within a container that cannot be accessed by a conventional pump assembly.

In such cases, the pooled or collected fluids cannot be pumped from the inside of the container because the siphon tube of the pump assembly (which is typically still disposed near the upwardly facing base of the inverted container) is not positioned within said pooled or collected fluids. Instead, any such collected fluid volume must be poured directly from the container; in such cases, the fluids pooled near the outlet of the container can be difficult to remove from the container in a controlled manner, resulting in unwanted spilling or splashing. Such spilling or splashing can be unsanitary, unpleasant and unsafe; in many cases, such fluid can increase the risk of slip and fall or other injuries.

Thus, there is a need for a dispensing assembly that permits the dispensing of desired volumes of fluid from conventional containers. The dispensing assembly should be relatively small, cost effective and efficient, while preventing waste associated with inadvertent spillage of fluids and discarding of containers holding residual fluid volume.

SUMMARY OF THE INVENTION

The dispensing assembly of the present invention generally comprises a container receptacle assembly having a container support section and a pump support section. Although said container and pump support sections can be separate from each other, in a preferred embodiment said container and pump support sections comprise a single (combined) unit formed of unitary or singular construction.

Said container support section comprises a container receptacle that is configured to securely support and hold a jug or other conventional container; said jug or other container is beneficially positioned and maintained in an inverted position, with a threaded outlet (which is normally facing upward on said conventional container), instead facing in a generally downward orientation. As a result of said inverted position, any liquids disposed within said jug or other container will gravity feed toward said downwardly facing outlet.

Said pump support section provides a housing for supporting a manual pump assembly. Although the specific configuration of said manual pump assembly can vary without departing from the scope of the present invention, said manual pump assembly generally comprises a fluid inlet that is in fluid communication with a hand actuator having a fluid outlet.

A conduit generally extends from said container outlet to said inlet of said pump assembly in order to permit fluid to flow from said container to said pump assembly. In a preferred embodiment, a threaded reusable cap member having a check valve assembly and quick-connect coupling can be installed on said threaded outlet of said container. Further, said container support section and said pump support section can be disposed in relatively close proximity to each other.

The method and apparatus of the present invention permits fluid (including, without limitation, thick or highly viscous fluids) to be efficiently dispensed in controlled amounts. Further, such fluid can be fully removed from a container prior to said container being discarded. Thus, the method and apparatus of the present invention results in full and efficient use of said fluid, while eliminating the need to employ other means for extracting residual fluid that can result in unwanted spillage or splashing of said fluid from a conventional container.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
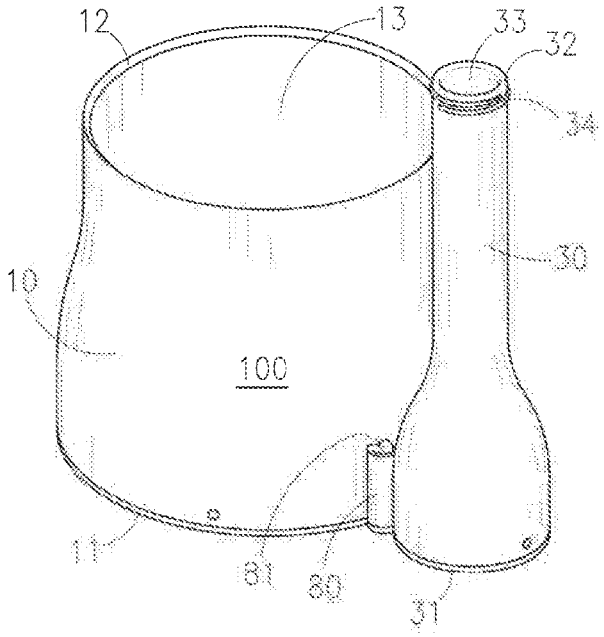
FIG. 1 depicts an overhead perspective view of certain components of dispensing assembly of the present invention with no container installed.
Figure 2:
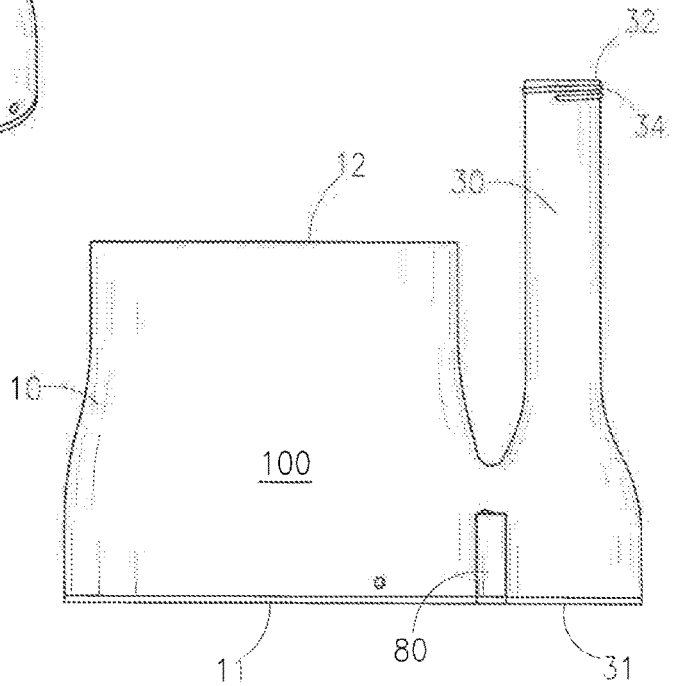
FIG. 2 depicts a side view of certain components of the dispensing assembly of the present invention with no container installed.
Figure 3:
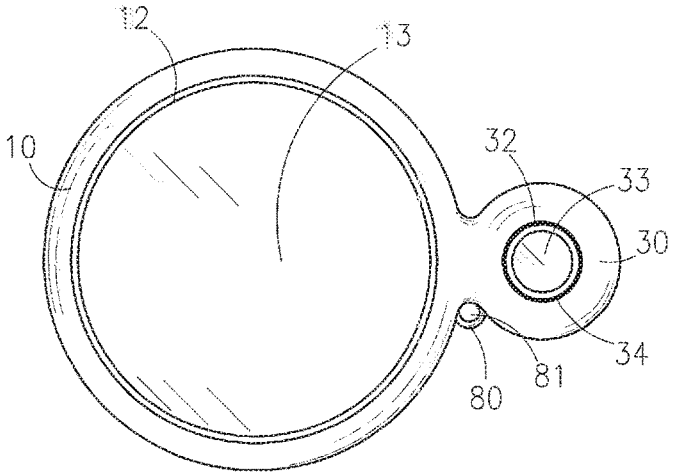
FIG. 3 depicts a top view of certain components of the dispensing assembly of the present invention with no container installed.

Referring to the drawings, FIG. 1 depicts an overhead perspective view of certain components of dispensing assembly of the present invention. FIG. 2 depicts a side view of said components of said dispensing assembly, while FIG. 3 depicts a top view of said components of said dispensing assembly of the present invention. In all of FIGS. 1 through 3, the depicted components of dispensing assembly—generally comprising a base member defining a container support platform/container receptacle 10 and pump support member 30—are shown without a fluid container or hand pump assembly installed.

Referring to FIGS. 1 through 3, the depicted components of dispensing assembly 100 comprise container support platform or container receptacle 10 having upper opening 12 and lower support base 11, and defining inner space 13. Container receptacle 10 is configured to at least partially receive a conventional container (such as a plastic jug and/or plastic bottle) within upper opening 12 and at least some portion of inner space 13 as described more fully below.

Still referring to FIGS. 1 through 3, the depicted components of dispensing assembly 100 further comprise pump support member 30 having upper opening 32 and lower support base 31, and defining inner space 33. Lower support bases 11 and 31 can be optionally formed of unitary or singular construction, can be separate components attached to one another, or can comprises separate and detached components. In a preferred embodiment, pump support member 30 is oriented substantially upright, having a central longitudinal axis that is substantially parallel to the central longitudinal axis of container receptacle 10. Said pump support member 30 is beneficially configured to support an external manual fluid hand pump. In a preferred embodiment, tool holder 80 defining inner space 81 is disposed between said container receptacle 10 and pump support member 30.

Dimensions of said components of dispensing assembly 100 depicted in FIGS. 1 through 3 can be altered or varied without departing from the scope of the present invention. However, by way of illustration but not limitation, in a preferred embodiment container support receptacle 10 has a vertical height of approximately 5.75 inches, while upper opening 12 has a diameter of approximately 5.0 inches and flares or tapers outward to a diameter of approximately 6.0 inches near base 11. Similarly, by way of illustration but not limitation, in a preferred embodiment pump support base 30 has a vertical height of approximately 10.75 inches, while upper opening 32 has a diameter of approximately 1.0 inch and flares or tapers outward to a diameter of approximately 2.5 inches near base 31. As noted above, dimensions of said components can be varied or changed without departing from the scope of the present invention.

Figure 4:
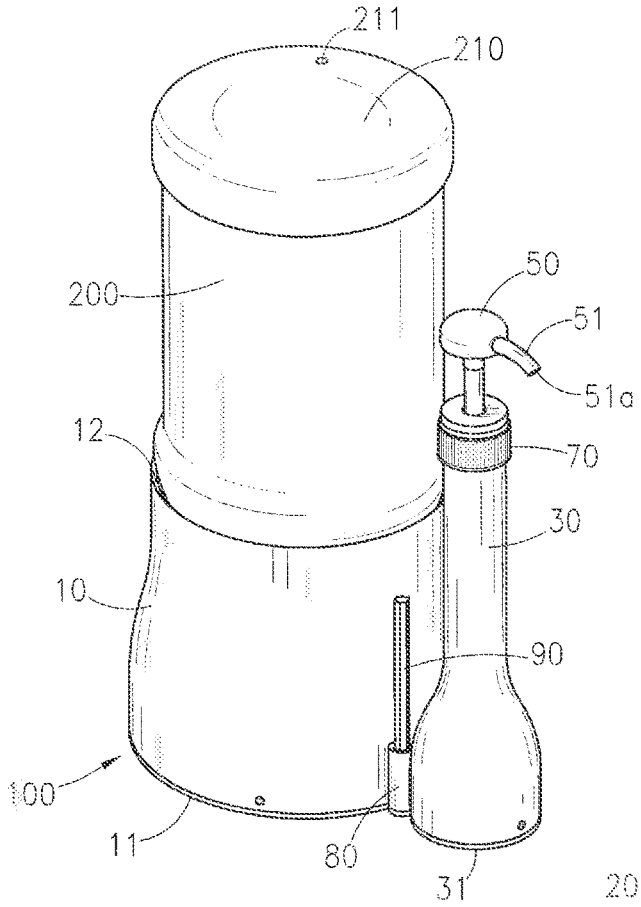
FIG. 4 depicts an overhead perspective view of the dispensing assembly of the present invention with a container and hand pump assembly installed.
Figure 5:
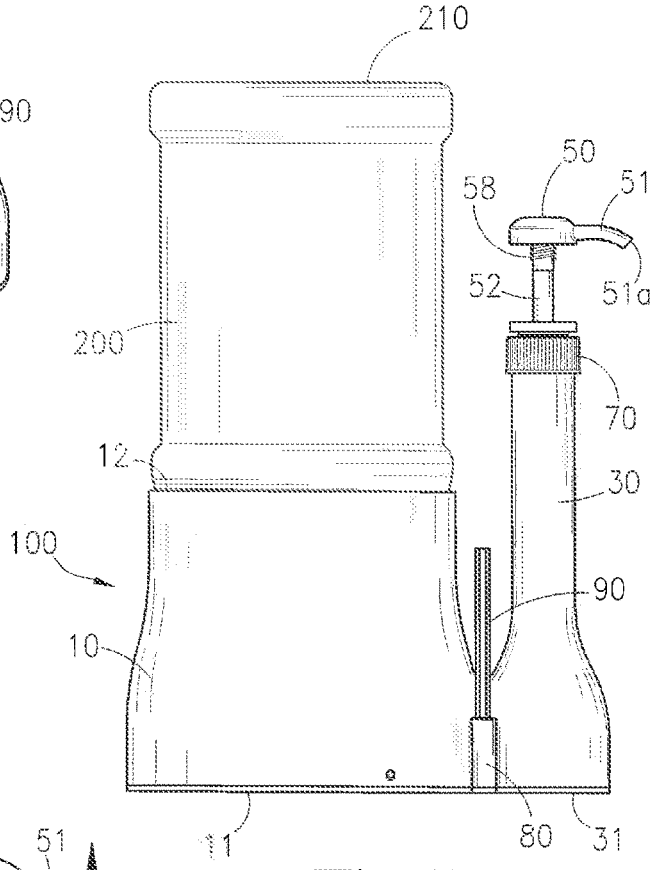
FIG. 5 depicts a side view of the dispensing assembly of the present invention with a container and hand pump assembly installed.
Figure 6:
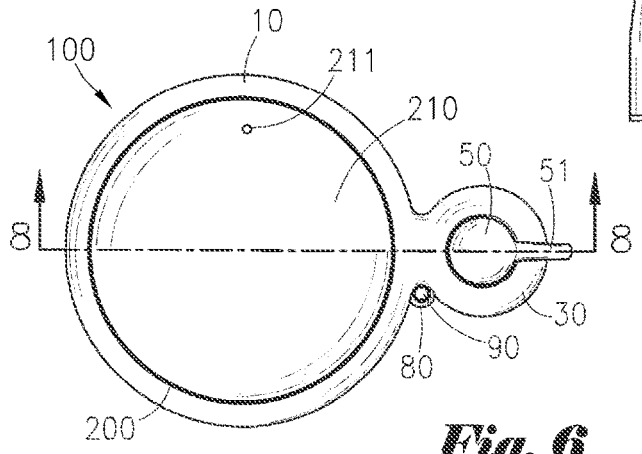
FIG. 6 depicts a top view of the dispensing assembly of the present invention with a container and hand pump assembly installed.

FIG. 4 depicts an overhead perspective view of dispensing assembly 100 of the present invention. FIG. 5 depicts a side view of said components of dispensing assembly 100, while FIG. 6 depicts a top view of said components of dispensing assembly 100 of the present invention. In each of FIGS. 4 through 6, dispensing assembly 100 is depicted with conventional fluid container 200 and hand pump assembly 50 installed.

Referring to FIGS. 4 through 6, dispensing assembly 100 comprises container receptacle 10 having upper opening 12 and lower support base 11. Container receptacle 10 is configured to partially receive a conventional container 200 (such as a plastic jug and/or plastic bottle) within upper opening 12; in this configuration, an outlet of said container 200 (which is typically facing upward when container 200 is upright—that is, supported by base 210) is oriented and maintained in a substantially downward orientation.

In the configuration depicted in FIGS. 4 through 6, container 200 is supported with base 210 positioned in a substantially upwardly-facing position. Fluid (including thick or highly viscous fluid) disposed within said container 200 will consistently drain or gravity feed to the downwardly facing outlet or exit of said container 200 (not visible in FIGS. 4 through 6). An optional vent hole or perforation 211 can be selectively formed or created within base 210 of container 200 to allow air to enter the inner chamber of container 200 and to facilitate flow of any such fluid from said container 200.

Still referring to FIGS. 4 through 6, dispensing assembly 100 further comprises pump support member 30 having upper opening 32 and lower support base 31. As previously noted, pump support member 30 is oriented substantially upright, having a central longitudinal axis that is substantially parallel to the central longitudinal axis of container receptacle 10 and container 200 supported therein. Tool holder 80 defining inner space 81 is disposed between said container receptacle 10 and pump support member 30. Puncture tool 90 can be received within inner space 81 and held in close proximity to container 200 for use when needed.

Said pump support member 30 is beneficially configured to support an external manual fluid hand pump; in a preferred embodiment, said hand pump can include pump assembly (actuator) 50, spout 51 having fluid outlet 51*a*, and pump stem 52 with external threaded section 53. Further, said manual fluid hand pump can operationally attach to upper opening 32 of support member 30 using pump adapter cap 70; said pump adapter cap 70 can include external friction-promoting ridges to promote gripping by a user's fingers during installation and/or removal of said adapter cap 70 from said pump support member 30.

In a preferred embodiment, said container receptacle 10 and external hand pump support base 30 are integrally formed of singular construction to comprise one piece, or are otherwise joined together. Although other dimensions can be employed without departing from the scope of the present invention, container receptacle 10 and external hand pump support base 30 can each have a wall thickness of approximately ⅛". Further, lower support bases 11 and 31 can be integrally formed of singular construction to comprise one piece, or can comprise multiple pieces. Further, said lower support bases 11 and 31 can be removeably attached to container receptacle 10 and pump support base 30, respectively; said lower support bases 11 and 31 can be selectively removed to beneficially permit access to inner space 13 and inner space 33 and any components of the present invention disposed within said inner spaces, and/or any fluid that might inadvertently escape from container 200 and/or other components of the present invention.

Figure 7:
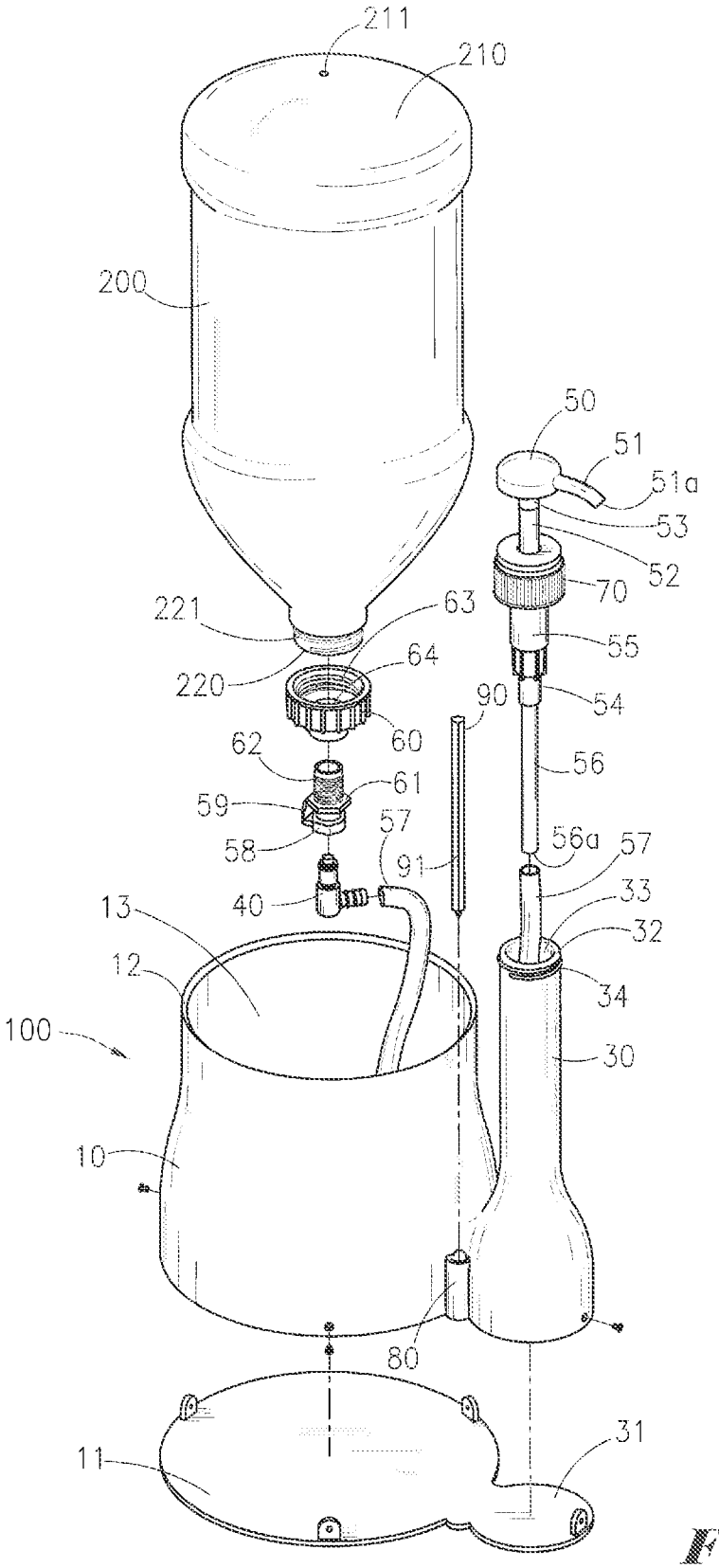
FIG. 7 depicts an exploded perspective view of the dispensing assembly of the present invention with a container and hand pump assembly installed.

FIG. 7 depicts an exploded perspective view of dispensing assembly 100 of the present invention with a conventional container 200 installed. Dispensing assembly 100 comprises container receptacle 10 having upper opening 12 and lower support base 11, and defining inner space 13. Container receptacle 10 is configured to partially receive a conventional container 200 (such as a plastic jug and/or plastic bottle) within upper opening 12; in this configuration, exit opening or outlet 220 of said container 200 is disposed within inner space 13, and is oriented and maintained in a substantially downward orientation. Said outlet 220 has external threads 221.

Pump support member 30 has upper opening 32 and lower support base 31, and defines an inner space 33. As previously noted, pump support member 30 is oriented substantially upright, having a central longitudinal axis that is substantially parallel to the central longitudinal axis of container receptacle 10 and container 200 supported therein. Said pump support member 30 is beneficially configured to support an external manual fluid hand pump assembly 50.

Still referring to FIG. 7, said hand pump assembly generally comprises pump actuator 50, spout 51 having fluid outlet 51*a*, and pump stem 52 with external threaded section 53. Pump stem 52 is operationally attached to pump housing 54 containing conventional fluid pump components well known to those having skill in the art. Pump housing adapter 55 connects said pump housing 54 to spacer tube 56; in a preferred embodiment, said spacer tube 56 comprises a substantially rigid tube member having desired dimensions, such as length, diameter and wall thickness.

Pump conduit 57 extends from lower end 56*a* of spacer tube 56; in a preferred embodiment, said pump conduit 57 is beneficially flexible and has desired dimensions, such as length, diameter and wall thickness. Pump conduit 57 extends through inner space 33 of pump base 30 into inner space 13 of container receptacle 10, and operationally attaches to elbow member 40 which, in turn, is attached to valve assembly 58 having release member 59 and external "nut" profile 61. In a preferred embodiment, each of said elbow member 40 and/or valve assembly 58 include a check valve that permits fluid flow from container 200 into pump conduit 57, but prevents fluid flow in the opposite direction; as a result, any fluid contained within said pump conduit 57 will not inadvertently leak or flow out of conduit 57 when said conduit 57 is disconnected from container 200.

External profile 61 of valve assembly 58 can engage with a conventional wrench or other tool in order to apply torque to said valve assembly 58. Outer threads 62 can mate with opposing threads disposed on the inner surface of bore 64 extending through cap member 60. Similarly, cap 60 has inner threads 63 that can mate with opposing external threads 221 on the outlet of container 200. Thus, it is to be observed that cap 60 can be selectively attached and/or removed from outlet 220 of container 200.

Further, said manual fluid hand pump can operationally attach to upper opening 32 of support member 30 using pump adapter cap 70. Said pump adapter cap 70 can include internal threads that are configured to selectively engage and mate with opposing external threads 34 disposed on pump base 30. Further, said pump adapter cap 70 can include external friction-promoting ridges to facilitate gripping by a user's fingers during installation and/or removal of said adapter cap 70 from said support member 30.

Tool holder 80 defining inner space 81 is disposed between said container receptacle 10 and pump support member 30. Puncture tool 90 having pointed end 91 can be received within inner space 81 and held in close proximity to container 200. When desired, puncture tool 90 can be used to puncture or otherwise create vent hole 211 through base 210 of container 200.

Figure 8:
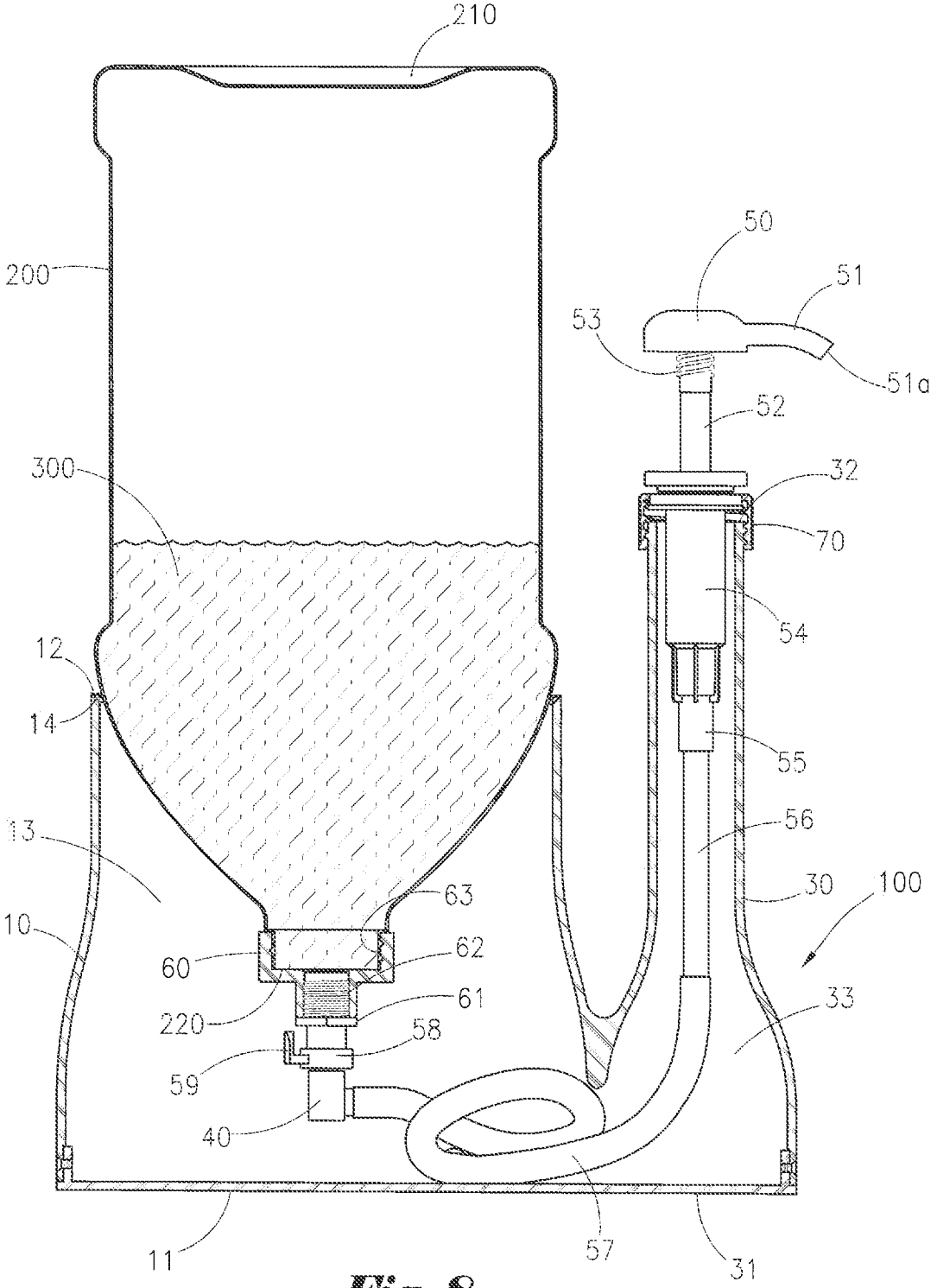
FIG. 8 depicts a sectional view of the dispensing assembly of the present invention along line 4-4 of FIG. 6.

FIG. 8 depicts a sectional view of dispensing assembly 100 of the present invention along line 4-4 of FIG. 6. Dispensing assembly 100 comprises container receptacle 10 having upper opening 12 and lower support base 11, and defining inner space 13. Conventional container 200 (such as a plastic jug and/or plastic bottle) is at least partially received within upper opening 12 of container receptacle 10. Outlet 220 having external threads 221 of said container 200 is oriented and maintained in a substantially downward orientation within inner space 13 of said container receptacle 10.

Pump support member 30 has upper opening 32 and lower support base 31, and defines an inner space 33. As previously noted, pump support member 30 is oriented substantially upright, having a central longitudinal axis that is oriented substantially parallel to the central longitudinal axis of container receptacle 10 and container 200 supported therein.

Hand pump assembly generally comprises pump actuator 50, spout 51 having fluid outlet 51*a*, and pump stem 52 with external threaded section 53; said hand pump assembly is operationally attached within upper opening 32 of pump support member 30 using (removable) pump adapter cap 70. Pump stem 52 is operationally attached to pump housing 54 which, in turn, is attached to pump housing adapter 55 and spacer tube 56; pump housing 55, pump housing adapter 55 and spacer tube 56 are generally disposed within inner space 33 of pump support member 30. In a preferred embodiment, pump base 30 has sufficient longitudinal rigidity and strength to withstand compression forces applied by a user to actuator 50 of said pump assembly.

Pump conduit 57 extends from lower end 56*a* of spacer tube 56; said pump conduit 57 extends through inner space 33 of pump base 30 into inner space 13 of container receptacle 10, and operationally attaches to valve assembly 58. Outer threads 62 mate with threads disposed on the inner surface of through bore 64 of cap member 60. Similarly, cap 60 has inner threads 63 that mate with opposing external threads 221 of container 200. Cap 60 can be selectively attached and/or removed from outlet 220 of container 200.

Referring to FIG. 8, container receptacle 10 can include optional silicone or elastomer gasket 14 at or near upper opening 12 that prevents container 200 from being gouged or punctured by said container receptacle 10. Container 200 can be a jug, bottle or other conventional container holding fluid 300; by way of illustration, but not limitation, such fluid can comprise, for example, hair shampoo, conditioner, liquid soap, or other fluid. Outlet 220 of said container 200 is maintained in a substantially downward position in inner space 13 of container receptacle 10. This orientation permits any fluid 300 within container 200 to continuously drain or gravity feed to said outlet 220 of container 200. In this configuration, fluid 300 will consistently collect or pool near valve assembly 58 (and, more specifically, the inlet thereof). Said container 200 can also include any original or added label(s) and/or other marking(s), which remain visible above container receptacle 10, so that a user can confirm the quality, quantity, composition and/or source of any fluid 300 contained within said container 200.

Removable and reusable cap member 60 can be selectively attached to threaded outlet 220 of container 200. In a preferred embodiment, said cap member 60 can include a NPT APC series acetal coupling body that allows removal of said cap 60 from container 200 without any waste of fluid, and/or twisting of cap member 60 off and/or on to outlet 220 of container 200. A NPT APC series acetal coupling body (shut-off), connected to a rotatable inline hose barb APC series acetal insert elbow 40 (shut-off), allows swiveling or rotating container 200 in any position desired (such as, for example, to position indicia or label on said container 200 in a particular direction for ease of display).

Dispensing assembly 100 of the present invention permits quick and efficient removal of container 200 (such as when empty of fluid 300), as well as connection to a new (full) replacement container. Importantly, slack in pump conduit 57 allows cap member 20 (and attached components of the present invention) to be quickly and efficiently attached to an outlet of new (that is, substantially full of fluid) container when said new container is in an upright position; said new container can then be inverted and at least partially installed within container receptacle 10, thereby eliminating unwanted splashing or spillage of any fluid. Pump conduit 57 also allows removal of pump adapter cap 70 and attached components from pump support base 30 to repair and/or replace said manual hand pump components, if needed.

Referring back to FIG. 7, vent hole 211 is formed or created in base 210 of container 200 (such as, for example, by puncturing a hole or vent in said container 200), thereby preventing the hand pump of the present invention from creating an air lock vacuum and/or collapsing container 200. Although other means can be used, puncture tool 90 can be readily accessible and used for this purpose.

Fluid dispensing assembly 100 of the present invention saves time and prevents waste, because users are not required to spend time removing residual fluid from a conventional container. Further, said fluid dispensing assembly 100 of the present invention promotes full extraction of fluid from a container, eliminating waste associated with discarding of containers having residual fluids remaining therein. The fluid dispensing assembly 100 of the present invention is described herein primarily in connection with hair salons and/or hair care products; however, it is to be observed that the present invention can be used in virtually any situation in which relatively small amounts of fluid are regularly pumped from relatively large bulk containers.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An apparatus for dispensing hair shampoo or other hair product from a container having a base, a contents label and an outlet comprising:
   a) a support assembly, wherein said support assembly further comprises:
      i) a container support member configured to receive a portion of said container, wherein a contents label on said container is at least partially exposed;
      ii) a fluid pump support member adapted to support a fluid pump;
   b) a manual fluid hand pump having an inlet and an outlet, wherein said fluid pump is at least partially disposed within said fluid pump support member;
   c) a flexible hose having a first end and a second end, wherein said flexible hose is configured to directly connect said container to said fluid pump, and wherein said first end is operationally attached to said outlet of said container and said second end is operationally attached to said inlet of said fluid pump; and
   d) a tool having a point configured to puncture a vent hole in said base of said container.

2. The apparatus of claim 1, wherein said container support member is configured to maintain said outlet of said container in a substantially downwardly facing orientation.

3. The apparatus of claim 1, further comprising a check valve disposed between said outlet of said container said first end of said flexible hose.

4. The apparatus of claim 3, wherein said check valve permits fluid to flow from said outlet of said container into said first end of said conduit flexible hose, but prevents fluid from flowing out of said first end of said conduit flexible hose.

5. The apparatus of claim 1, wherein said container comprises a plastic jug.

6. The apparatus of claim 1, further comprising a swivel disposed between said outlet of said container said first end of said flexible hose.

7. The apparatus of claim 1, wherein said support assembly comprises a single piece of unitary construction.

8. The apparatus of claim 1, further comprising a base removeably attached to said support assembly.

9. A method for dispensing hair shampoo or other hair product from a container having a base, a contents label and an outlet comprising:

a) providing a dispensing assembly, wherein said support assembly further comprises:
   i) a container support member configured to receive at least a portion of said container;
   ii) a fluid pump support member adapted to support a fluid pump;
   iii) a manual fluid hand pump having an inlet and an outlet, wherein said manual fluid hand pump is at least partially disposed within said fluid pump support member;
   iv) a flexible hose having a first end and a second end, wherein said flexible hose is configured to directly connect said container to said fluid pump, and wherein said second end is operationally attached to said inlet of said manual fluid hand pump;
b) connecting said first end of said flexible hose to said outlet of said container;
c) installing said container into said container support member, wherein said outlet of said container is maintained in a substantially downwardly facing orientation, and wherein fluid in said container drains toward said outlet of said container, and a contents label on said container is at least partially exposed;
d) puncturing a vent hole in the base of said container;
e) applying force to said manual fluid hand pump; and
f) dispensing fluid from said container, through said hose to said inlet of said manual fluid hand pump, and through said outlet of said manual fluid hand pump.

10. The method of claim 9, further comprising a check valve disposed between said outlet of said container said first end of said conduit flexible hose.

11. The method of claim 10, wherein said check valve permits fluid to flow from said outlet of said container into said first end of said conduit, but prevents fluid from flowing out of said first end of said flexible hose.

12. The method of claim 9, wherein said container comprises a plastic jug.

13. The method of claim 9, wherein said dispensing assembly further comprises a swivel disposed between said outlet of said container said first end of said flexible hose.

14. The method of claim 9, wherein said container support member and fluid pump support member comprise a single piece of unitary construction.

15. The method of claim 9, wherein said dispensing assembly further comprises a base removeably attached to said container support member and fluid pump support member.

16. The method of claim 9, further comprising:
a) removing said container from said container support member after substantially all fluid has been removed from said container;
b) disconnecting said first end of said flexible hose from said outlet of said container;
c) connecting said first end of said flexible hose to an outlet of a replacement container;
d) installing said replacement container into said container support member, wherein said outlet of said replacement container is maintained in a substantially downwardly facing orientation, and wherein fluid in said replacement container drains toward said outlet of said replacement container; and
e) dispensing fluid from said replacement container through said outlet of said manual fluid hand pump.

17. The method of claim 9, wherein said contents label on said container remains visible after said container is installed into said container support member.

* * * * *